US009209530B2

(12) United States Patent
Gassauer et al.

(10) Patent No.: US 9,209,530 B2
(45) Date of Patent: Dec. 8, 2015

(54) CONDUCTOR CONNECTION TERMINAL HAVING IMPROVED OVERLOAD PROTECTION

(71) Applicant: WAGO Verwaltungsgesellschaft mbH, Minden (DE)

(72) Inventors: Stephan Gassauer, Ilfeld (DE); Fabian Wenig, Artern (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 10 days.

(21) Appl. No.: 14/248,870

(22) Filed: Apr. 9, 2014

(65) Prior Publication Data

US 2014/0308855 A1 Oct. 16, 2014

(30) Foreign Application Priority Data

Apr. 11, 2013 (DE) ..... 10 2013 103 658

(51) Int. Cl.
*H01R 13/10* (2006.01)
*H01R 33/00* (2006.01)
*H01R 4/48* (2006.01)

(52) U.S. Cl.
CPC ..... *H01R 4/48* (2013.01); *H01R 4/4836* (2013.01)

(58) Field of Classification Search
CPC ..... H01R 4/48; H01R 4/4836
USPC ..... 439/682, 852, 725, 752.5, 877, 850, 439/849, 884, 851, 853, 856
See application file for complete search history.

(56) References Cited

U.S. PATENT DOCUMENTS

2011/0250803 A1* 10/2011 Bies ..... 439/752.5

FOREIGN PATENT DOCUMENTS

| | | | |
|---|---|---|---|
| DE | 42 39 480 | A1 | 5/1994 |
| DE | 196 29 563 | A1 | 1/1998 |
| DE | 196 46 103 | C1 | 3/1998 |
| DE | 197 35 835 | A1 | 2/1999 |

(Continued)

*Primary Examiner* — Javaid Nasri
(74) *Attorney, Agent, or Firm* — Renner, Otto, Boisselle & Sklar, LLP

(57) ABSTRACT

A conductor connection terminal (1) comprising an insulating housing (2) and comprising at least one spring-force clamping connection (5) in the insulating housing (2) for making the terminal connection of an electrical conductor is described. The spring-force clamping connection (5) has a base plate (6) and at least one spring tongue (7), which is at an angle to the base plate (6), is connected in a root region (8) to the base plate (6) and extends with its tongue end (9), which is movable in spring-elastic fashion, in a conductor plug-in direction (L). The free tongue end (9) is spaced apart from the base plate (6) by a gap (15). The insulating housing (2) has at least one actuating pushbutton (4), which interacts with the tongue end (9) opposite the base plate (6) and has an actuating section (14), which extends in the direction towards the base plate (6), for deflecting the spring tongue (7) transversely to the direction of extent of the spring tongue (7). The actuating pushbutton (4) has at least one resting section (20), which is designed in each case at an associated tongue end (9) to rest on a lateral peripheral edge (19) of the associated tongue end (9) and to shift the tongue end (9) in the direction of the base plate (6) whilst reducing the width of the gap (15) when the actuating pushbutton (4) is shifted in the direction of the base plate (6) so as to open a clamping connection formed by the spring tongue (7) for an electrical conductor of which a terminal connection is intended to be made.

9 Claims, 8 Drawing Sheets

(56) References Cited

FOREIGN PATENT DOCUMENTS

| | | | |
|---|---|---|---|
| DE | 20 2005 018 168 | U1 | 2/2006 |
| DE | 10 2010 014 143 | A1 | 10/2011 |
| DE | 10 2010 014 144 | A1 | 10/2011 |
| DE | 10 2011 015 968 | A1 | 10/2012 |
| EP | 2375503 | A2 | 10/2011 |

* cited by examiner

CONDUCTOR CONNECTION TERMINAL HAVING IMPROVED OVERLOAD PROTECTION

FIELD OF THE INVENTION

The invention relates to a conductor connection terminal comprising an insulating housing and comprising at least one spring-force clamping connection in the insulating housing for making the terminal connection of an electrical conductor and wherein the spring-force clamping connection has a base plate and at least one spring tongue, which is at an angle to the base plate and is connected in a root region to the base plate and extends with its tongue end, which is movable in spring-elastic fashion, in a conductor plug-in direction, and wherein the free tongue end is spaced apart from the base plate by a gap, and the insulating housing has at least one actuating pushbutton, which interacts with the tongue end opposite the base plate and has an actuating section for deflecting the spring tongue transversely to the direction of extent of the spring tongue, which actuating section extends in the direction towards the base plate.

BACKGROUND OF THE INVENTION

DE 20 2005 018 168 U1 discloses a spring-force terminal comprising an insulating housing and at least one leg spring in the insulating housing. On deflection of the clamping leg of the leg spring with an actuating tool, the clamping end of the clamping leg hits against an abutment, which is bent out of a clamping cage in one piece. An overextension of the leg spring is thus avoided.

DE 42 39 480 A1 discloses a connection terminal comprising an actuating pushbutton which is mounted pivotably in an insulating housing and a cage tension spring. In order to limit the pivoting movement of the actuating pushbutton and therefore the deflecting movement of the clamping spring, a stop is provided on the housing, against which stop the actuating pushbutton rests in the event of a maximum pivoting movement.

DE 196 46 103 C1 has disclosed a cage tension spring comprising a bent leg section at that end of the resting leg which faces a window opening. The bent leg section acts as supporting element of the upper leg of the clamping spring in order to prevent overextension of the clamping spring.

DE 196 29 563 A1 discloses a clamping spring arrangement comprising a cage tension spring, with an elastically formed separate insert part being inserted into the inner loop area thereof. The insert part in this case limits the deflecting movement of the clamping spring.

DE 197 35 835 A1 discloses an electrical terminal in the manner of a tunnel comprising leaf springs which are stamped free from tunnel side walls in mirror-symmetrical fashion. An electrical conductor is clamped between two leaf springs, which are arranged at a distance from one another and extend in the same conductor plug-in direction, so as to form a terminal connection.

DE 10 2010 014 143 A1 and DE 10 2010 014 144 A1 disclose an electrical connection terminal and an actuating device therefor comprising an insulating housing and comprising at least one spring-force connection in the form of a contact frame. The contact frame is formed from a flat metal material and is formed in the manner of a channel with at least two side walls and a contact base. In order to form a conductor clamping connection, the contact frame has in each case one leaf spring in the manner of a tongue shaped from the flat metal part, which tongue is bent out of the plane of the flat metal part, on each side wall. The at least sectionally funnel-shaped conductor insertion region is at least virtually closed circumferentially and is formed jointly from the contact frame and by the insulating housing. The actuation is performed using a pushbutton, which is joined, as pushbutton arm, to the insulating housing and extends along at least a subsection of two surfaces of the insulating housing which are arranged at an angle to one another. The pushbutton arm has an actuating section which dips into the interspace between two leaf spring tongues and a protruding material tongue at the free end, which material tongue rests in an end position on the insulating housing in order to prevent a further actuation downwards.

OBJECT OF THE INVENTION

Against this background, it is the object of the present invention to improve such a conductor connection terminal of the generic type in respect of overload protection and operation.

SUMMARY OF THE INVENTION

In the case of a conductor connection terminal of the generic type, it is proposed that the actuating pushbutton has at least one resting section, which is designed to rest on a lateral peripheral edge of the associated tongue end and to shift the tongue end in the direction of the base plate whilst reducing the width of the gap as the actuating pushbutton is shifted in the direction of the base plate so as to open a clamping connection formed by the spring tongue for an electrical conductor of which a terminal connection is intended to be made.

In contrast to the known solutions, the actuating pushbutton is therefore not intended to be held with a stop on the insulating housing in an end position. Instead, it is proposed that the resting section of the actuating pushbutton together with the tongue end to be actuated forms a stop. This is achieved by virtue of the fact that the resting section rests on a lateral peripheral edge of the tongue end. A further deformation of the tongue end in the direction of the base plate with a reduction of the gap width is permitted by virtue of the gap between the tongue end and the base plate. The further deflection of the tongue end is limited by the base plate, however, with the result that, once the tongue end hits the base plate, i.e. when the gap width in a region of the gap is reduced to zero, a stop for the actuating pushbutton is formed.

The flexible deflection of the actuated tongue end when the resting section hits the associated lateral peripheral edge of the actuated spring tongue has the advantage that the stop is comparatively clearly noticeable for the user. The stop which now acts via the spring tongue on the base plate also provides increased overload protection than is possible with a stop against the insulating housing.

It is advantageous if the spring-force clamping connection has two spring tongues which are spaced apart from one another, and are at an angle to the base plate, extend in the conductor plug-in direction and together form a clamping point for an electrical conductor of which a terminal connection can be made between the spring tongues. The spring tongues therefore protrude away from the base plate and are at an angle, preferably approximately transversely at an angle of approximately 60 degrees to 120 degrees to the plane of the base plate.

The spring-force clamping connection is in this case preferably in the form of a contact frame of the type described in DE 10 2010 014 143 A1 and DE 10 2010 014 144 A1.

By virtue of the fact that the spring tongues are at an angle to the base plate and the tongue ends are spaced apart from the base plate with a gap, the actuating pushbutton exerts a force, directed in the direction of the base plate, on the spring tongue, as a result of which the spring tongues are shifted in the direction towards the base plate owing to the spring-elastic properties of the spring-force clamping connection.

In this case, it is particularly advantageous if the at least one spring tongue is formed integrally with the base plate. The spring tongue and the base plate can in this case be shaped from a sheet-metal part, for example. For this purpose, a sheet-metal part is correspondingly folded over in a reshaping process, wherein the tongue ends are cut or stamped free from the base plate.

Furthermore, it is advantageous if at least one spring tongue tapers at the tongue end. By virtue of the tongue end which preferably tapers adjacently towards the base plate, the gap with respect to the base plate can be provided. However, it is particularly advantageous also if the base plate is inclined in the direction towards the actuating pushbutton in the conductor plug-in direction in the section adjoining the tongue end. By virtue of the inclination of the base plate, a run-in funnel for an electrical conductor of which a terminal connection is to be made is provided and the guidance of that end of an electrical conductor from which the insulation has been stripped towards the clamping point is improved. By virtue of the tapering spring tongues, the spring characteristic of the spring clamping connection can be further improved.

It is particularly advantageous if the at least one spring tongue has, at its free tongue end, a flap of material which extends in the direction of the actuating pushbutton and is bent away from the plane of the tongue end. Then, the actuating section of the actuating pushbutton is designed to be guided along the flap of material when the actuating pushbutton is shifted in the direction of the base plate. With the aid of such flaps of material which protrude from the spring tongue upwards away from the base plate in the direction of the actuating push button, the lateral peripheral edge of the tongue ends is extended in the region of the actuating section of an associated actuating pushbutton. That section of the lateral peripheral edge of the tongue end which adjoins the flap of material is then used by the resting section of the actuating pushbutton in order to push on the lateral peripheral edge in the end position and then shift the tongue end further in the direction towards the base plate whilst reducing the gap. The opening of the clamping point formed by the at least one tongue end is therefore performed by virtue of the actuating section, which interacts with the flap of material and possibly with a section of the tongue end which is positioned therebelow. The end stop of the actuating pushbutton, on the other hand, is provided by the lateral peripheral edge adjoining the flap of material in conjunction with the resting section of the actuating pushbutton.

Preferably, the actuating pushbutton is formed integrally with the insulating housing. In this case it is particularly advantageous if the actuating pushbutton has a first arm section, which is aligned transversely to the base plate, and is connected to the insulating housing, and a movable second arm section, which adjoins the first arm section and has a spring bow, and a free end section, which extends parallel to the base plate. Then, the actuating section protruding in the direction of the base plate and the at least one laterally protruding resting section are arranged on the free end section.

With such an arm section which emerges from a connecting region with the insulating housing and is aligned transversely to the base plate, and with the arm section which extends via a spring bow to a parallel to the base plate, an actuating pushbutton is realized in the manner of a spring arm which springs back elastically to an initial position. It is advantageous here when the actuating pushbutton has a certain prestress and as a result a force effect is always developed in the direction of the associated spring tongue. As a result, the actuating pushbutton, in the initial position in which the spring-force clamping connection is unactuated and the resting section is shifted away an associated side wall edge of the tongue end, remains in an initial position without being secured there by a stop. The pretensioning causes an enlargement of the actuating path with the result that the spring force of the actuating pushbutton is used more optimally. The pretensioning further results in the force required for actuating the actuating pushbutton, i.e. for shifting the actuating pushbutton in the direction towards the base plate, is reduced since the actuating pushbutton, as a result of the pretensioning, does not counteract the actuating force to the same degree as would be the case for an actuating pushbutton without pretensioning.

BRIEF DESCRIPTION OF THE DRAWINGS

The invention will be explained in more detail below with reference to an exemplary embodiment using the attached drawings, in which.

DETAILED DESCRIPTION OF THE INVENTION

Figure 1:
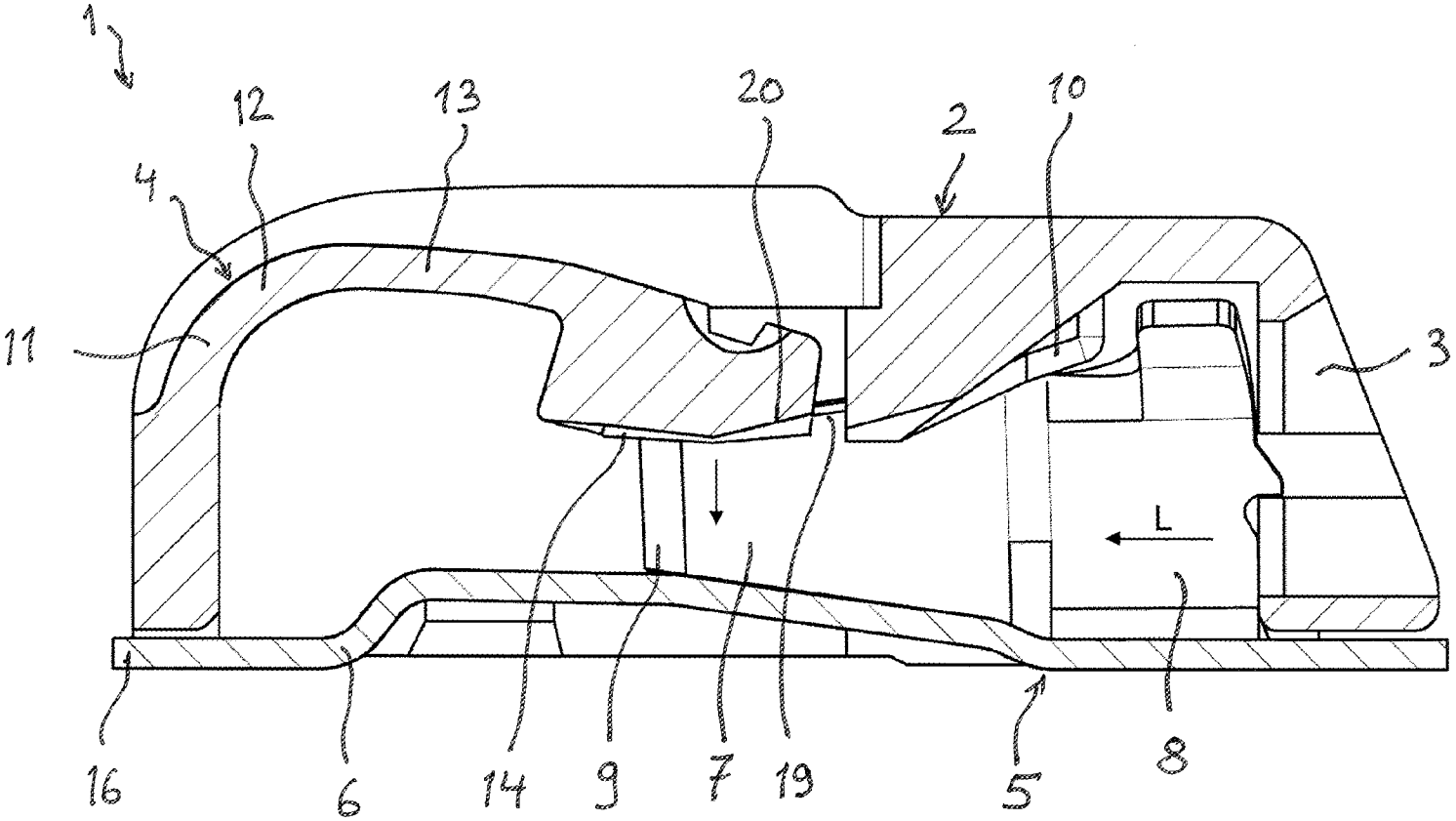
FIG. 1—shows a sectional view from the side through a conductor connection terminal comprising an actuating pushbutton depressed in the direction towards the base plate, in the open position of the spring-force clamping connection.

FIG. 1 shows a sectional view from the side of a conductor connection terminal 1. The conductor connection terminal 1 has an insulating housing 2 having a conductor insertion opening 3 in the front side and an actuating pushbutton 4 on the rear side, which is opposite the conductor insertion opening 3 in the insulating housing 2. A spring-force clamping connection 5 is installed in the insulating housing 2, and is formed as a contact frame with a base plate 6 and two spring tongues 7 which are transverse to the base plate 6 and are spaced apart from one another. The spring tongues 7 are integrally connected to the base plate 6 in a section which adjoins the conductor insertion opening 3 and forms a root region 8. For this purpose, the spring tongues 7 are formed integrally from a sheet-metal material with the base plate 6. The root region 8 is in this case curved in a direction transverse to the base plate 6 in order to form a conductor insertion funnel for inserting an electrical conductor through the conductor insertion opening 3 and the conductor insertion funnel to a clamping point. The inserted end of an electrical conductor from which the insulation has been stripped (not illustrated) is guided on all sides by the inclined base plate and the mutually opposite tongue ends 9 of the spring tongues 7 and by an upper wall 10 of the insulating housing 2.

It can be seen that the actuating pushbutton extends in a first arm section 11 transversely to the base plate 6. "Transversely" is understood to mean not only an angle of precisely 90 degrees, but an angle which protrudes from the base plate 6, i.e. in the range of from approximately 60 degrees to 120 degrees. In this first arm section, the actuating pushbutton 4 is formed integrally with the insulating housing 5 and is still connected thereto. This is adjoined by a spring bow 12, from where the actuating pushbutton 4 extends towards the free end of a second arm section 13 in the direction of the conductor insertion opening 3 parallel to the base plate 6. "Parallel" in this context is understood to mean that the main direction of extent of the actuating pushbutton 13 approximately follows the base plate 6 located therebeneath and is aligned at an angle of approximately plus/minus 30 degrees with respect to the base plate 6. The angle is also dependent on the deflection of the second arm section 13.

It can be seen from FIG. 1 that the actuating pushbutton 4 is shifted with its second arm section 13 in the direction of the base plate 6. In this case, an actuating section 14 protrudes at the free end of the actuating pushbutton 13 downwards in the direction of the base plate 6 and bears laterally against the tongue ends 9. Thus, the tongue ends 9 are shifted outwards from a conductor insertion axis, which is predetermined by the conductor insertion direction 3 and the funnel-shaped runin of the spring-force clamping connection 5. In this way, a clamping point formed by the spring tongues 7 for an electrical conductor for which a terminal connection is to be made is opened.

The arrow pointing downwards in the direction of the base plate 6 indicates the direction of force in which the actuating pushbutton 4 is shifted in the direction of the base plate 6 so as to open the clamping point.

It is clear that the spring tongues 7 are stamped or cut free from the base plate 6 and a gap 15 is provided between the base plate 6 and the spring tongue 7. In the illustrated actuating position of the actuating pushbutton 4 in which the clamping point is open, the spring tongues 7 are tilted downwards in the direction of the base plate 6 with the result that the width of the gap 15 is reduced in comparison with the unactuated state shown in FIG. 2 and the spring tongue 7 hits the base plate 6 possibly at least in one subregion. This is achieved by virtue of the fact that a resting section 20 which protrudes laterally from the actuating pushbutton rests on a lateral peripheral edge 19 (see FIG. 2) of the tongue end 9 of the spring tongue 7 and, when the actuating pushbutton 4 is depressed further in the direction of the base plate 6, a force is exerted on the tongue end 9 in the direction of the base plate 6.

It is furthermore clear that the conductor connection terminal 1 of the exemplary embodiment illustrated is in the form of an SMD printed circuit board terminal. The base plate 6 in this case protrudes from the insulating housing 2 on both sides, namely on the front side and on the rear side, and forms solder pads 16 with which the conductor connection terminal can be soldered to a printed circuit board.

Figure 2:
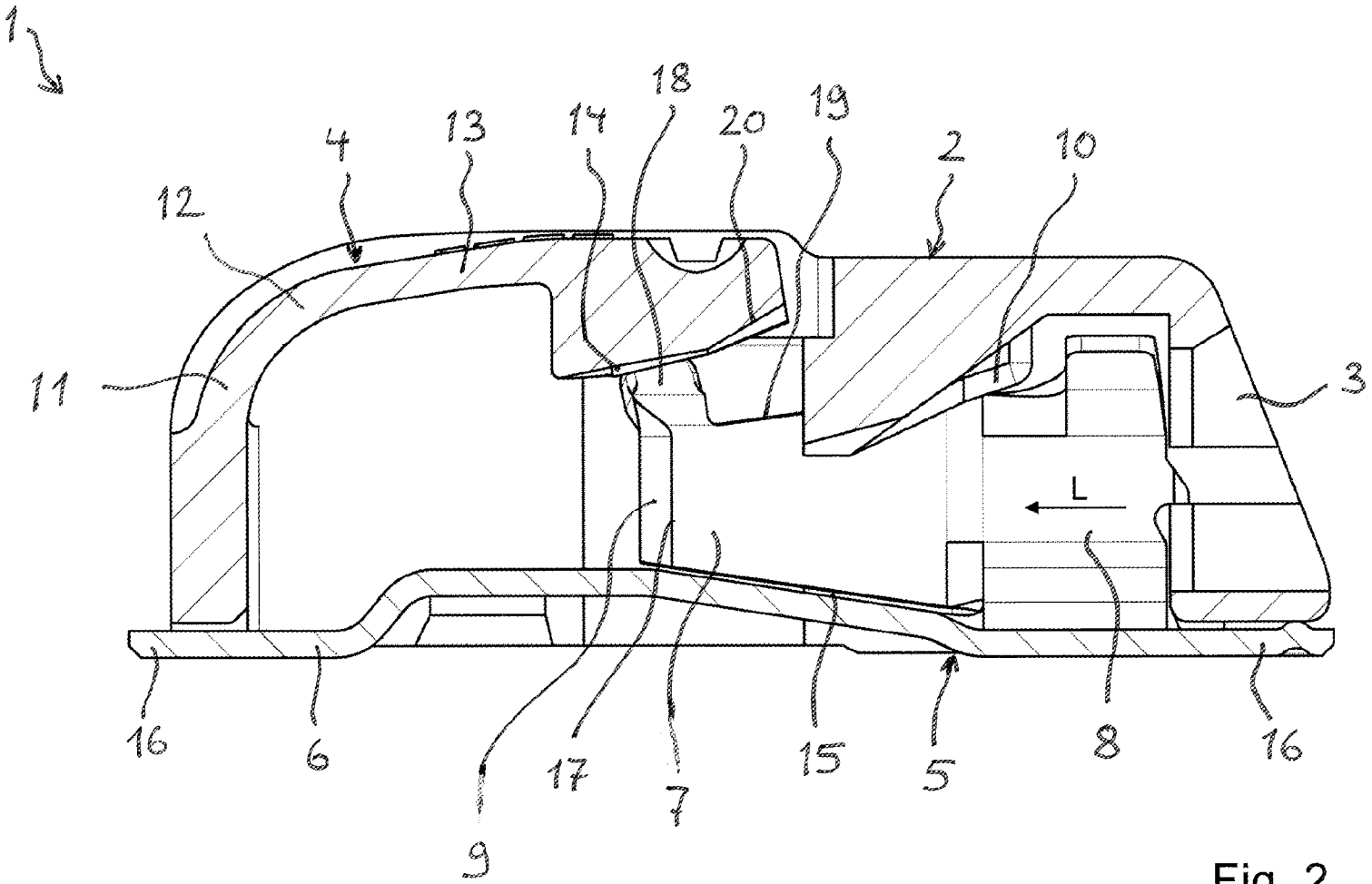
FIG. 2—shows a sectional view from the side (longitudinally centrally) through the conductor connection terminal shown in FIG. 1 with the actuating pushbutton shifted away from the base plate.

FIG. 2 shows a sectional view from the side of the conductor connection terminal 1 shown in FIG. 1 in the unactuated state of the actuating pushbutton 4 (in a section longitudinally centrally through the conductor connection terminal). It is clear that the second arm section 13 has now been pivoted/shifted upwards away from the base plate 6. By virtue of pretensioning of the actuating pushbutton 4, said actuating pushbutton is then held in the open position illustrated without the need for any further latching. In this open position, the actuating section 14 which protrudes downwards in the direction of the base plate 6 does not interact with the associated tongue ends of the spring tongues 7 with the result that said tongue ends can spring back freely towards one another in the direction of the conductor guide axis. Therefore, a plugged-in electrical conductor (not illustrated) can be provided with a terminal connection at clamping edges 17, which are formed on the inner side of the tongue ends 9 of the spring tongues 7. Such clamping edges 17 can be formed, for example, by virtue of the fact that the tongue ends 9 are beveled so as to be conically tapered at the free ends.

It can furthermore be seen that in each case a flap of material 18 which is bent away from the plane of the tongue end 9 is provided in each case at the free ends of the spring tongues 7 opposite the base plate 6. Said flap of material is located in the region adjoining the actuating section 14 of the actuating pushbutton 4 in order to act so as to guide the actuating pushbutton 4 and so as to deflect the tongue ends 9 outwards when the actuating pushbutton 4 with the actuating section 14 is depressed.

It is furthermore clear that the tongue ends 9, adjacent to the flap of material 18, have a lateral peripheral edge 19, on which a resting section 20 of the actuating pushbutton 4 rests, said resting section protruding laterally from the actuating section 14, when the actuating pushbutton 4 is shifted into the actuating position as shown in FIG. 1.

In the open position illustrated, the gap 15 between the tongue end 9 and the base plate 6 is visible since, in the unloaded open position, the tongue end 9 springs upwards away from the base plate 6. Only in the event of actuation as shown in FIG. 1 is the width of the gap 15 reduced by an actuating force being applied to the stop of the resting section 20 of the actuating pushbutton 4 on the lateral peripheral edge 19.

Figure 3:
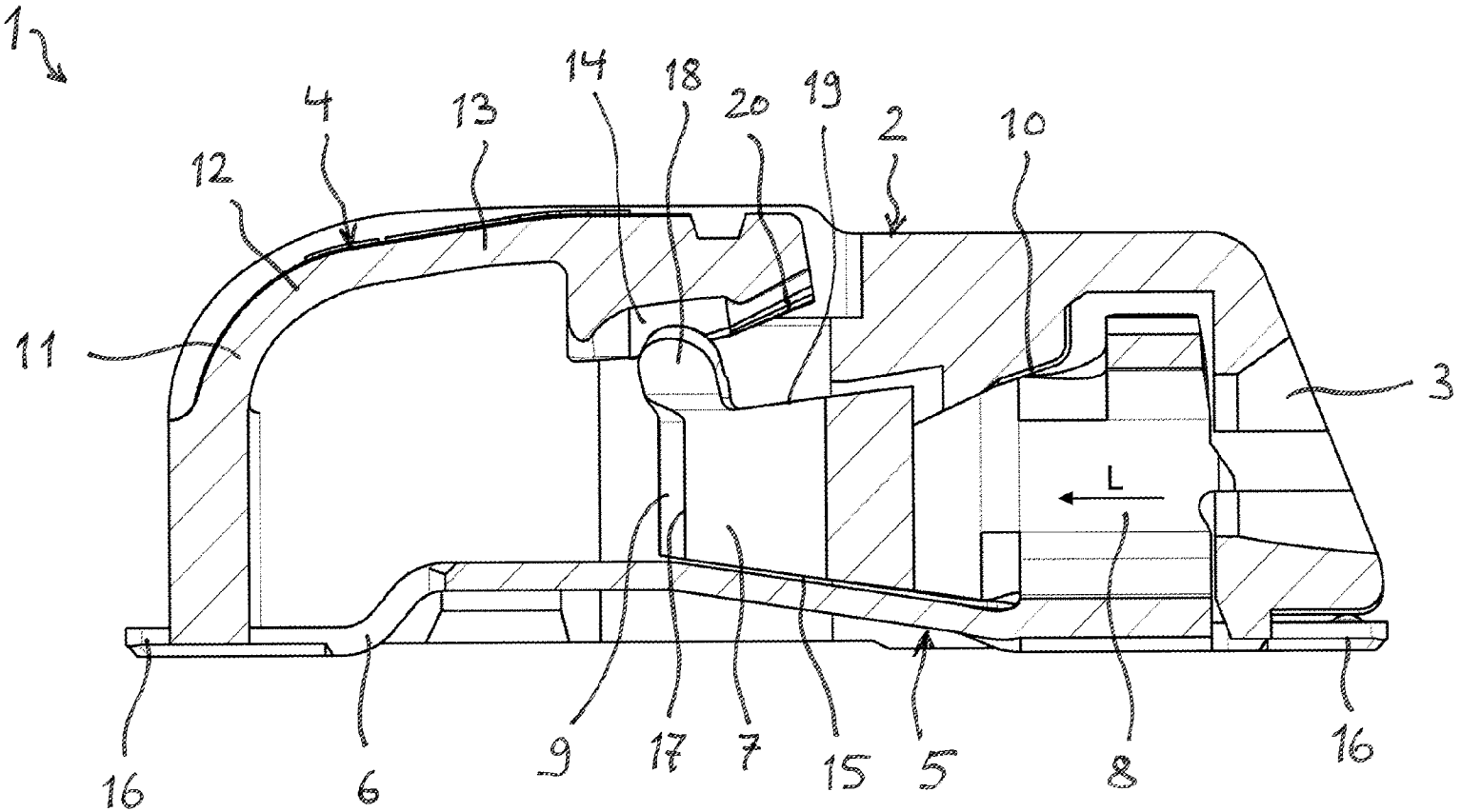
FIG. 3—shows a sectional view from the side (eccentric) of the conductor connection terminal shown in FIG. 2 with the actuating pushbutton shifted away from the base plate.

FIG. 3 shows a sectional view from the side in an eccentric section through the conductor connection terminal 1 in the unactuated state of the actuating pushbutton 4. It is clear that the actuating section 14 is drawn deeper in the direction of the base plate 6 in the central region, which enters between two spring tongues 7, and therefore has a greater thickness than in the peripheral region, which in each case protrudes beyond the upper edge of the spring tongues 7. As a result, a stop of the actuating pushbutton 4 against the spring tongue 7 for the depressed actuating state is thus provided, in which the laterally protruding resting section 20 rests on the upper edge (lateral peripheral edge 19) of the associated tongue end 9 of the spring tongue 7 when the actuating pushbutton is actuated.

Figure 4:
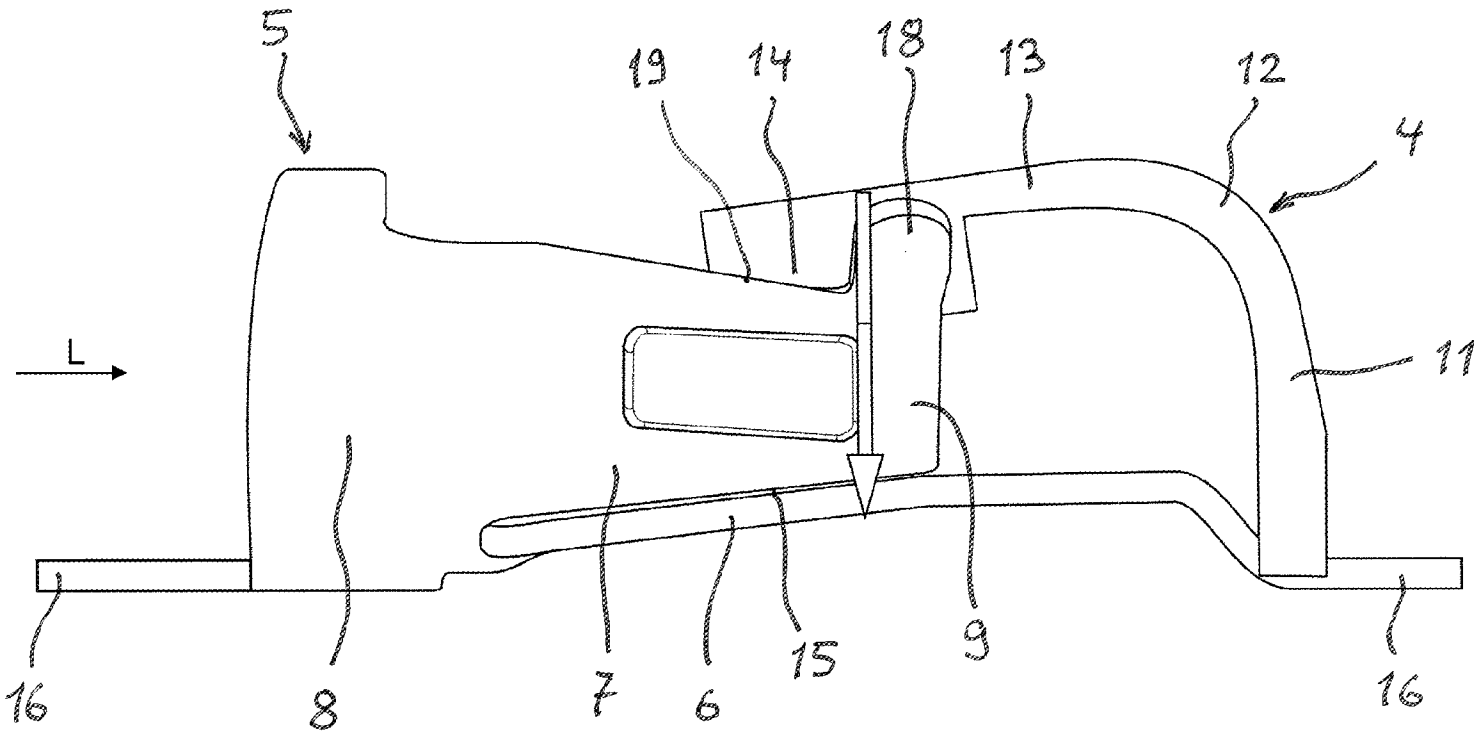
FIG. 4—shows a sketch of a spring-force clamping connection comprising an actuating pushbutton in the depressed open position of the spring-force clamping connection.

FIG. 4 shows a side view of the spring-force clamping connection 5 shown in FIG. 1 with the actuating pushbutton 4 in the actuating position. It is clear that the actuating section 14 protrudes in the form of a protruding bead into the space between the flap of material 18 and the adjoining tongue end 9 of the spring tongue 7. In this position, a laterally protruding resting section 20 of the actuating pushbutton 4 rests on that lateral peripheral edge 19 of the associated tongue end 9 which is opposite the base plate 6 and the gap 15. In this way, a force is exerted in the arrow direction on the tongue end 9 of the spring tongue 7 by the actuating pushbutton 4, and this force shifts the tongue end 9 in the direction of the base plate 6. Thus, the width of the gap 15 is reduced until the tongue end 9, possibly with a lateral peripheral edge which is opposite the upper lateral peripheral edge 19, hits the base plate 6 at least in a subregion. That region of the actuating pushbutton which is extended and extends from the actuating section 14 towards the free end of the actuating pushbutton 4 therefore hits, with its laterally protruding resting section 20, on the upper lateral peripheral edge 19 of the spring tongues 7, in an actuating position in which the wedge-shaped actuating section 14 dips to the maximum extent between the spring tongues 7, in order to prevent the actuating pushbutton 4 from dipping further between the spring tongues 7. The spring tongues 7 for their part yield in the actuating direction (arrow direction), until they rest on the base plate 6, i.e. the contact base of the contact insert. This base plate 6 can possibly for its part also yield elastically within certain limits. As a result, a greater degree of overload protection is ensured in the case of a comparatively clear stop feeling.

Figure 5:
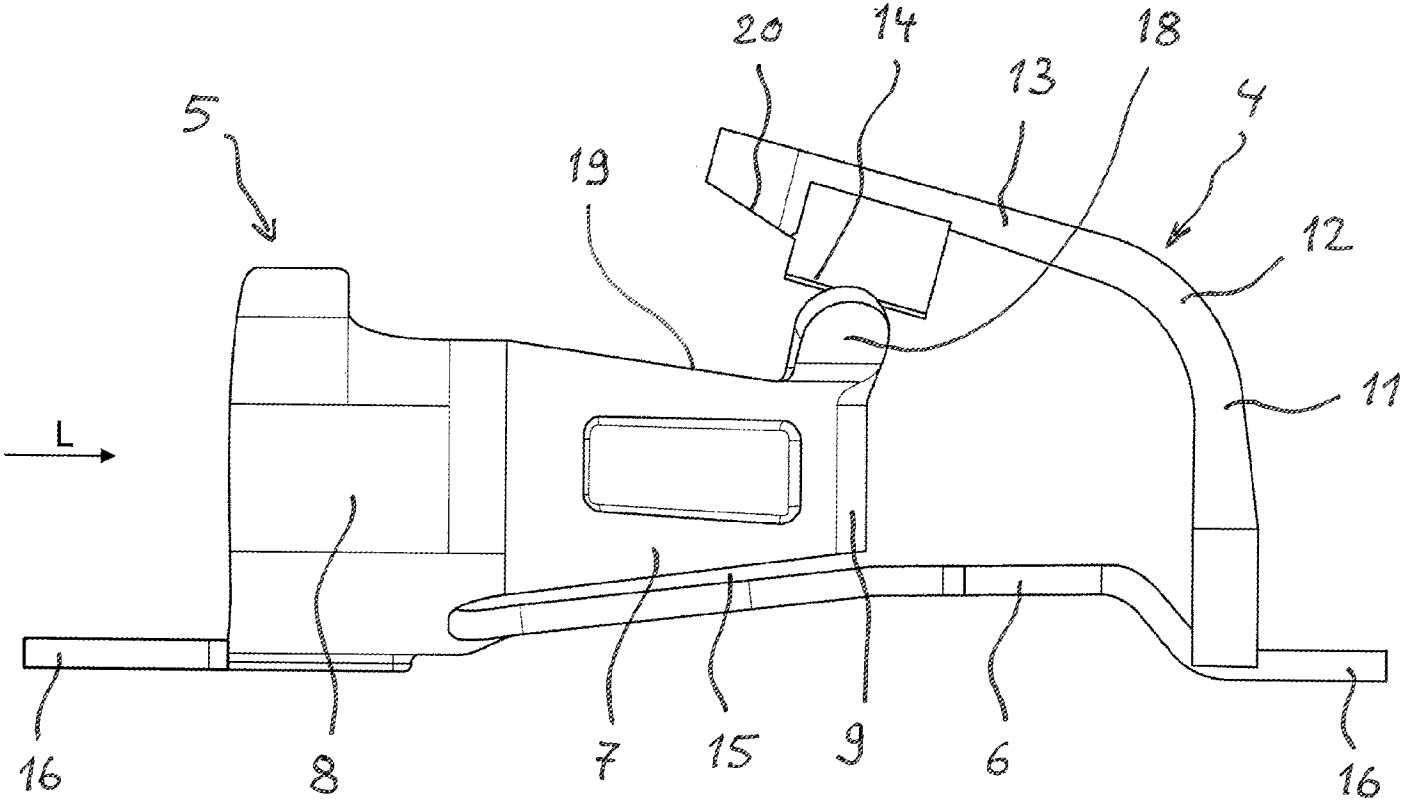
FIG. 5—shows a sketch of the spring-force clamping connection shown in FIG. 3 comprising an actuating pushbutton shifted away for a base plate in its initial position.

FIG. 5 shows a side view of the spring-force clamping connection 5 shown in FIG. 3 in the unactuated state of the actuating pushbutton 4. It is clear here that the spring tongues 7 with their tongue ends 9 are shifted upwards away from the base plate 6 and, in the process, a gap 15 is formed which has a greater width with respect to the base plate 6 between the tongue ends 9 and the base plate 6.

The conductor connection terminal illustrated can have any desired number of such spring-force clamping connections 5 in an insulating housing 2 and can therefore have 1, 2, 3, 4, 5 or more poles. However, it is also conceivable for the conductor connection terminal to be configured as a connecting terminal such that a plurality of illustrated spring-force clamping connections 5 are arranged next to one another and share a common base plate 6 or are electrically conductively connected to one another via cross-wiring. The conductor connection terminal can in this case be in the form of a printed circuit board terminal, as illustrated, or else in the form of a terminal box, a terminal strip or another conductor connection terminal in an electrical device. These different variants for the use of spring-force clamping connections in insulating housings for the terminal connection of electrical conductors are known per se from other types of spring-force clamping connections.

Figure 6:
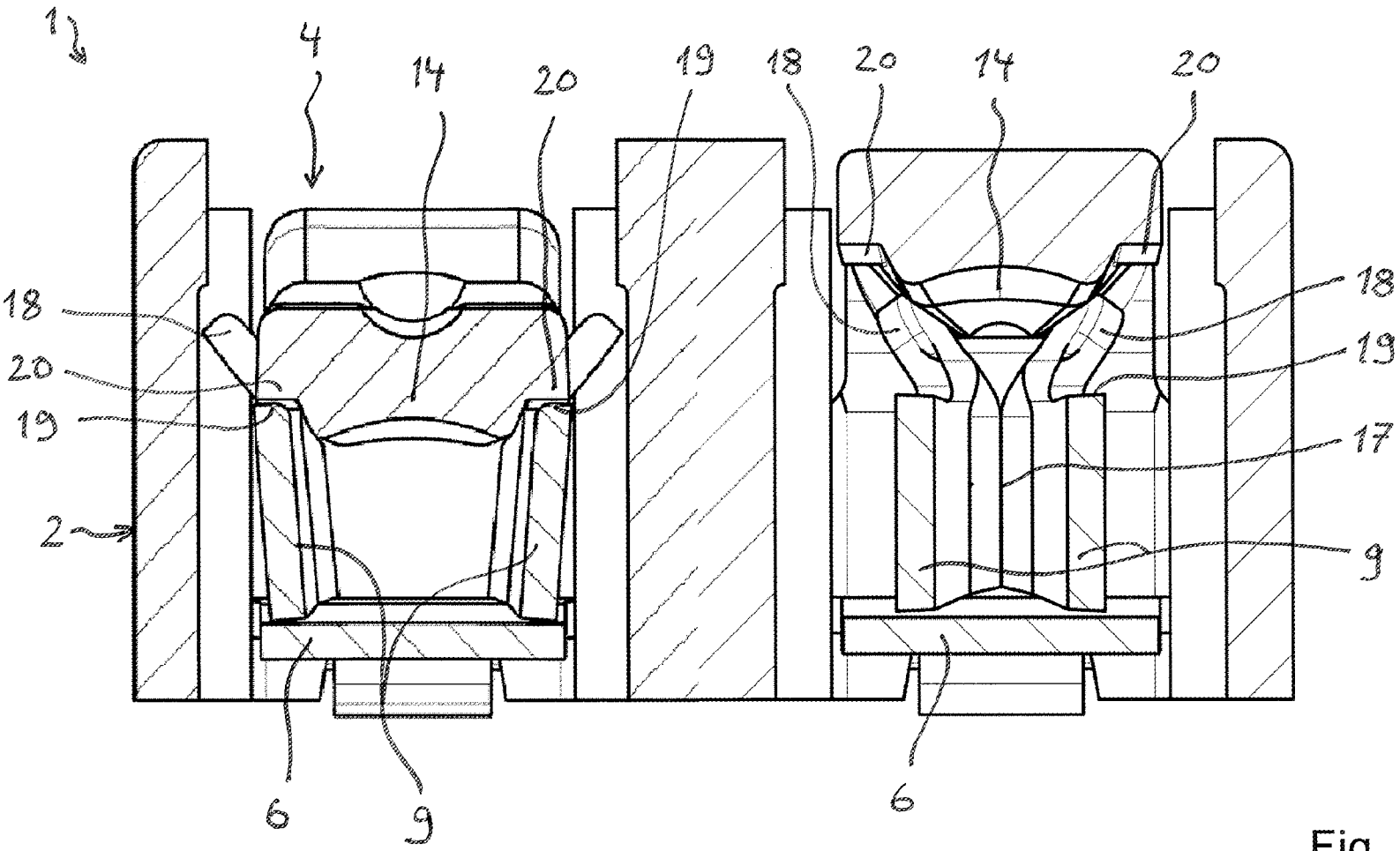
FIG. 6—shows a cross-sectional view of the conductor connection terminal shown in FIGS. 2 and 3 in the unactuated and actuated state in section transversely through a stop for a resting section of the actuating pushbutton.

FIG. 6 shows a cross-sectional view through a conductor connection terminal 1 comprising two spring-force clamping connections 5 positioned next to one another and associated actuating pushbuttons 4. In this case, the left-hand spring-force clamping connection 5 has been opened by the depressed actuating pushbutton 4, while the right-hand spring-force clamping connection 5 is unactuated or is closed with the actuating pushbutton 4 pivoted upwards away from the base plate 6.

The cross-sectional view is illustrated in a section through the laterally protruding resting section 20. It is clear that in the left-hand, actuated state, the laterally protruding resting sections 20 rest on the upper lateral peripheral edges 19 of the associated tongue ends 9 of the spring-force clamping connection 5. Thus, when an actuating force is exerted downwards in the direction of the base plate 6, the tongue ends 9 are shifted towards the base plate 6 until the tongue ends 9 hit the base plate 6. This provides the user with a clear force feeling when an end actuating position is reached.

In the right-hand open position, the actuating section 14 of the actuating pushbutton 4 is pivoted upwards away from the base plate 6. In this case, the tongue ends 9 of the spring-force clamping connection 5 are shifted towards one another in comparison with the actuated open position on the left-hand side in order to clamp an electrical conductor in between said tongue ends. This is achieved by virtue of the fact that the actuating section 14 releases the space between the tongue ends 9.

It can be seen that, starting from the laterally protruding resting sections 20, the central region of the actuating section 14 protrudes in the direction of the base plate 6. The actuating section 14 is thus thicker in the longitudinally central region than in the lateral peripheral region of the protruding resting sections 20.

Figure 7:
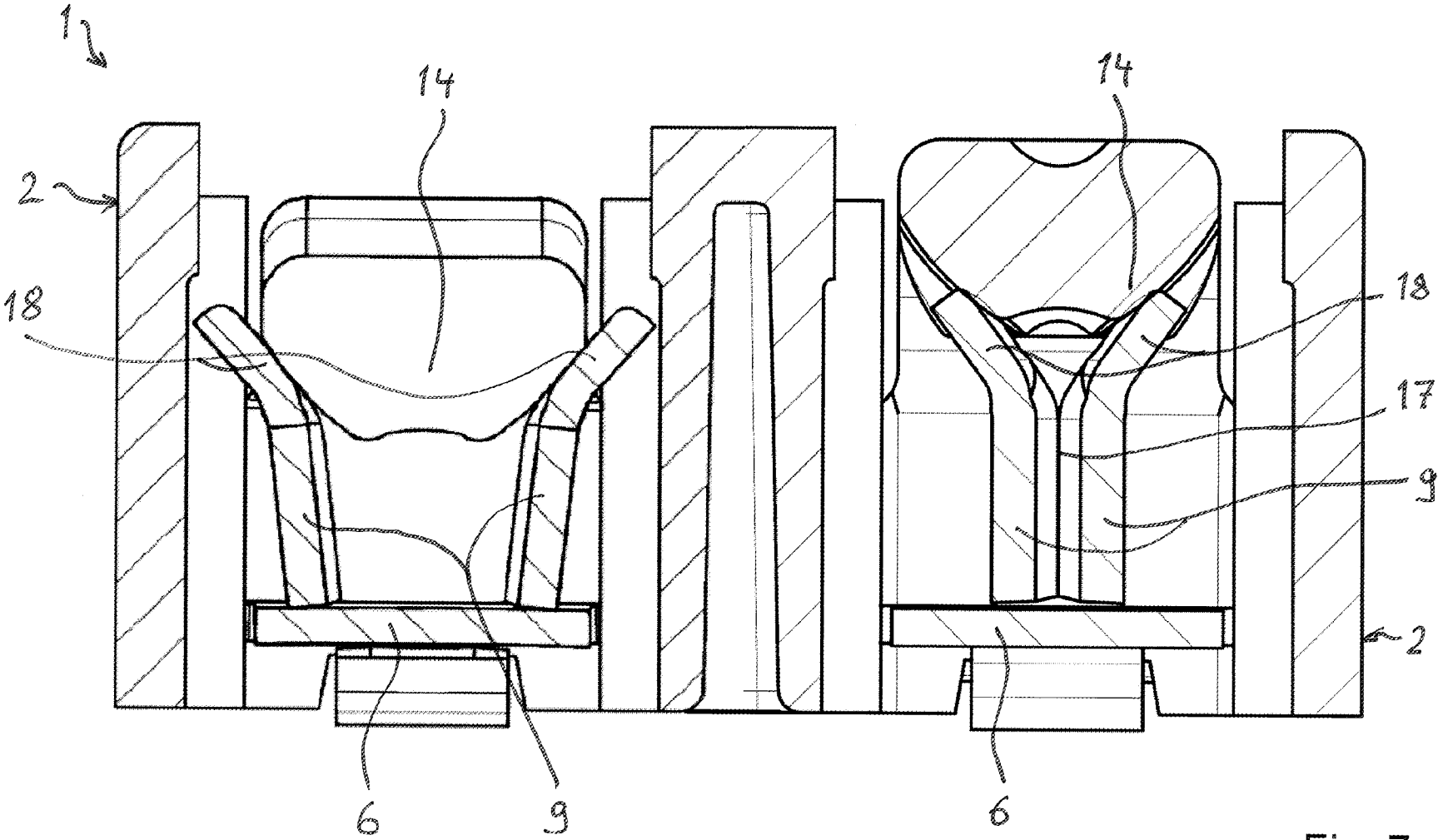
FIG. 7—shows a cross-sectional view through the conductor connection terminal shown in FIGS. 2 and 5 in the unactuated and actuated state in section transversely through an actuating section.

FIG. 7 shows a cross-sectional view of the conductor connection terminal 1 as shown in FIG. 6 in a section through the wedge-shaped actuating section 14 in the region of action of the tongue ends 9. It is clear that the thicker, wedge-shaped actuating section 14 which protrudes in the direction of the base plate 6 rests laterally on the flaps of material 18, which are connected to the tongue ends 9, and pushes said flaps of material away from one another from the unactuated position shown on the right-hand side into the left-hand open position.

Figure 8:
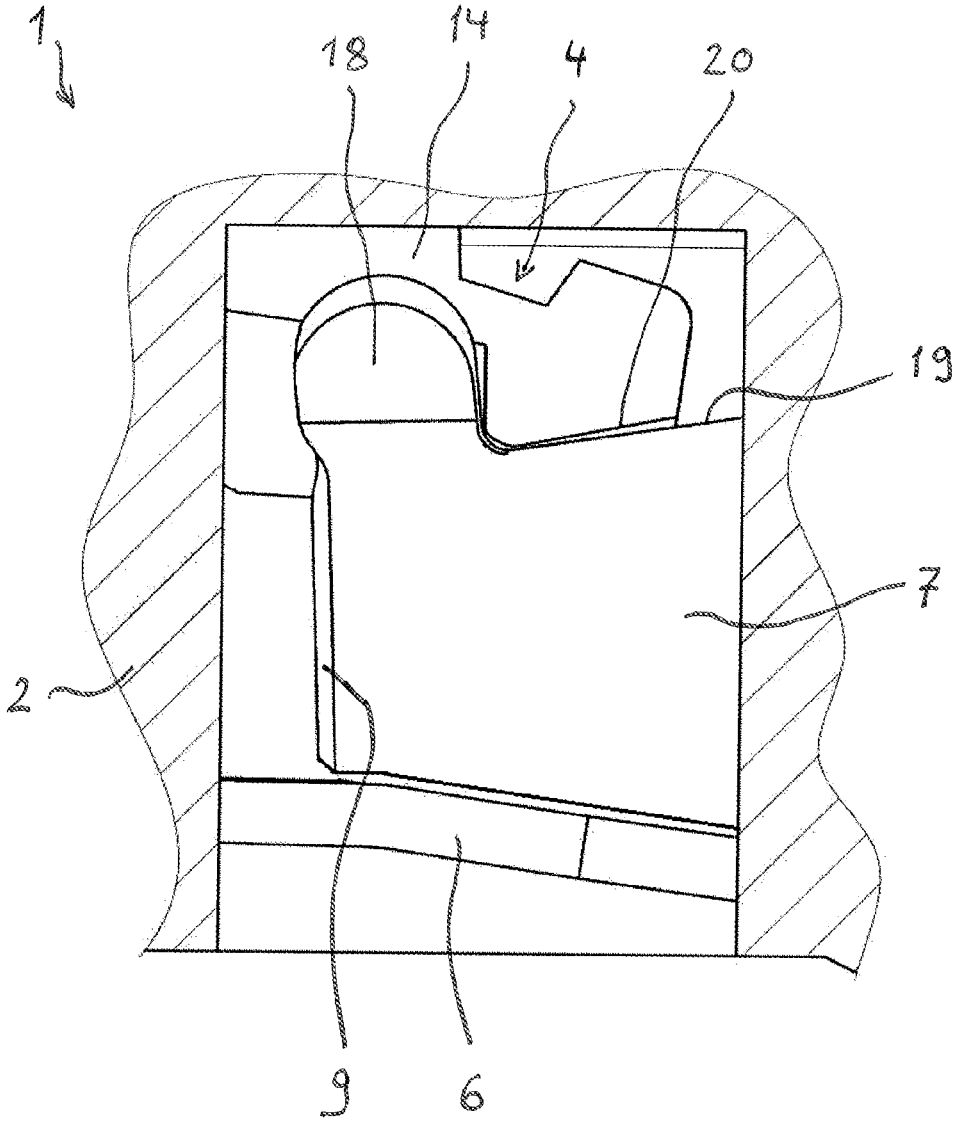
FIG. 8—shows a partial sectional view in cross section through a conductor connection terminal, broken away in the actuating region of spring tongues.

FIG. 8 shows a sectional view as a detail of the tongue ends 9 and a resting section 20 of the actuating pushbutton 4. It is clear that the resting section 20, in the open position illustrated there, with the actuating pushbutton 4 depressed, rests on the upper lateral peripheral edge 19 of the associated tongue end 9. Thus, the tongue end 9 is shifted in the direction of the base plate 6 to such an extent that the tongue end 9 rests on the base plate 6.

A defined force application area for an actuating tool (for example a screwdriver) can be provided on the upper side of the actuating pushbutton 4. For this, for example, a notch (not shown) can be introduced into the upper side of the actuating pushbutton 4. The position of this notch is preferably in the region between the stop 19 located therebeneath and the application area of the actuating pushbutton 4 at the tongue end 9, which is located in the region of the flap of material 18 in the exemplary embodiment. As a result, optimum force transfer both onto the tongue end 9 and onto the stop 19 is achieved, and the risk of excessive loading and deformation of the actuating pushbutton 4 is counteracted.

The invention claimed is:

1. A conductor connection terminal comprising an insulating housing and comprising at least one spring-force clamping connection in the insulating housing for making the terminal connection of an electrical conductor, wherein the spring-force clamping connection has a base plate and at least one spring tongue, which is at an angle to the base plate and is connected in a root region to the base plate and extends with its tongue end, which is movable in spring-elastic fashion, in a conductor plug-in direction, and where the free tongue end is spaced apart from the base plate by a gap, and the insulating housing has at least one actuating pushbutton, which interacts with the tongue end opposite the base plate and has an actuating section for deflecting the spring tongue transversely to the direction of extent of the spring tongue, wherein the actuating pushbutton has at least one resting section, which is designed to rest on a lateral peripheral edge of the associated tongue end and to shift the tongue end in the direction of the base plate whilst reducing the width of the gap as the actuating pushbutton is shifted in the direction of the base plate so as to open a clamping connection formed by the spring tongue for an electrical conductor of which a terminal connection is intended to be made.

2. The conductor connection terminal according to claim 1, wherein the spring-force clamping connection has two spring tongues which are spaced apart from one another, and are at an angle to the base plate, extend in the conductor plug-in direction and together form a clamping point for an electrical conductor of which a terminal connection can be made between the spring tongues.

3. The conductor connection terminal according to claim 1, wherein the at least one spring tongue is formed integrally with the base plate.

4. The conductor connection terminal according to claim 3, wherein the at least one spring tongue and the base plate are shaped from a sheet-metal part.

5. The conductor connection terminal according to claim 1, wherein the at least one spring tongue tapers at least at the tongue end.

6. The conductor connection terminal according to claim 5, wherein the base plate is inclined in the direction towards the actuating pushbutton in the conductor plug-in direction in the section adjoining the tongue end.

7. The conductor connection terminal according to claim 1, wherein the at least one spring tongue has, at its free tongue end, a flap of material which extends in the direction of the actuating pushbutton and is bent away from the plane of the tongue end, and in that the actuating section of the actuating pushbutton is designed to be guided along the flap of material when the actuating pushbutton is shifted in the direction of the base plate.

8. The conductor connection terminal according to claim 1, wherein the actuating pushbutton is formed integrally with the insulating housing.

9. The conductor connection terminal according to claim 8, wherein the actuating pushbutton has a first arm section, which is aligned transversely to the base plate, and is connected to the insulating housing, and a movable second arm section, which adjoins the first arm section and has a spring bow, and a free end section, which extends parallel to the base plate, wherein the actuating section and the at least one laterally protruding resting section are arranged on the free end section.

* * * * *